United States Patent [19]

McClendon

[11] 4,245,707

[45] Jan. 20, 1981

[54] GRADING AND DOZING ATTACHMENT FOR A TRACTOR

[76] Inventor: Marshall K. McClendon, P.O. Box 728, Duplessis, La. 70737

[21] Appl. No.: 935,559

[22] Filed: Aug. 21, 1978

[51] Int. Cl.[2] ..... E02F 3/76

[52] U.S. Cl. ..... 172/788; 172/742

[58] Field of Search ..... 172/297, 308, 742, 743, 172/781, 788, 795, 796, 797, 801, 804

[56] References Cited

U.S. PATENT DOCUMENTS

| | | | |
|---|---|---|---|
| 1,967,379 | 7/1934 | Stewart | 172/804 |
| 2,601,380 | 6/1952 | Flory | 172/742 X |
| 2,629,946 | 3/1953 | Ewers et al. | 172/804 |
| 2,749,630 | 6/1956 | Nave | 172/804 |
| 3,007,266 | 11/1961 | Brand | 172/788 |
| 3,195,249 | 7/1965 | Collins | 172/743 X |
| 3,542,136 | 11/1970 | Coontz | 172/742 X |
| 3,618,671 | 11/1971 | Chantland | 172/297 |

*Primary Examiner*—Richard T. Stouffer

*Attorney, Agent, or Firm*—David L. Ray; Edgar E. Spielman

[57] ABSTRACT

A grading and dozing attachment for a tractor including a blade located between the front wheels and the back wheels of the tractor, a carrying frame adapted to fit between the front wheels and the rear wheels of the tractor, the frame having a plurality of symmetrically disposed legs attachable to the rear axle of the tractor and a lifting mechanism connected to the tractor and the carrying frame for pivoting the carrying frame upwardly and downwardly about the rear axle, plates for adjusting the angle of the blade in a horizontal plane attached to the carrying frame by pins, and plates attached to the blade for adjusting the angle of the blade in a vertical plane.

1 Claim, 6 Drawing Figures

GRADING AND DOZING ATTACHMENT FOR A TRACTOR

BACKGROUND OF THE INVENTION

The present invention relates to a grading or dozing device and more particularly to that type of device which is power operated by being attached to a tractor or other power driven means.

As is well known in the art, grading devices are used extensively not only for grading and dozing but for many other tasks wherein they are subjected to strenuous service and severe abuse. Because of the abusive use to which the device is subjected, it is customary to make them very rugged which increases the weight, makes transportation from one job to another difficult, and necessitates the incorporation of somewhat complicated means for adjusting the angle and tilt of the blade for the different operations the device is called upon to perform.

Exemplary of the many dozing and grader blade assemblies for tractors and other devices are those disclosed in U.S. Pat. Nos. 3,800,882; 3,749,180; 3,542,136; 2,629,946; and 2,452,408.

To adapt small tractors to use for grading or dozing it is necessary that the dozer attachment be constructed in a manner such that the overall weight is relatively low. Furthermore, it is desirable to eliminate the use of as many complex hydraulic controls as possible to avoid needless and sometimes prohibitive expense and to utilize the hydraulic controls available on small farm tractors.

SUMMARY OF THE INVENTION

The grading and dozing attachment of the present invention includes a blade located between the front wheels and the back wheels of the tractor, a carrying frame adapted to fit between the front wheels and the rear wheels of the tractor, the frame having a plurality of symmetrically disposed legs attachable to the rear axle of the tractor and a lifting mechanism connected to the tractor and the carrying frame for pivoting the carrying frame upwardly and downwardly about the rear axle, plates for adjusting the angle of said blade in a horizontal plane attached to the carrying frame by pins, and plates attached to the blade for adjusting the angle of the blade in a vertical plane.

DESCRIPTION OF THE PREFERRED EMBODIMENT

Figure 1:
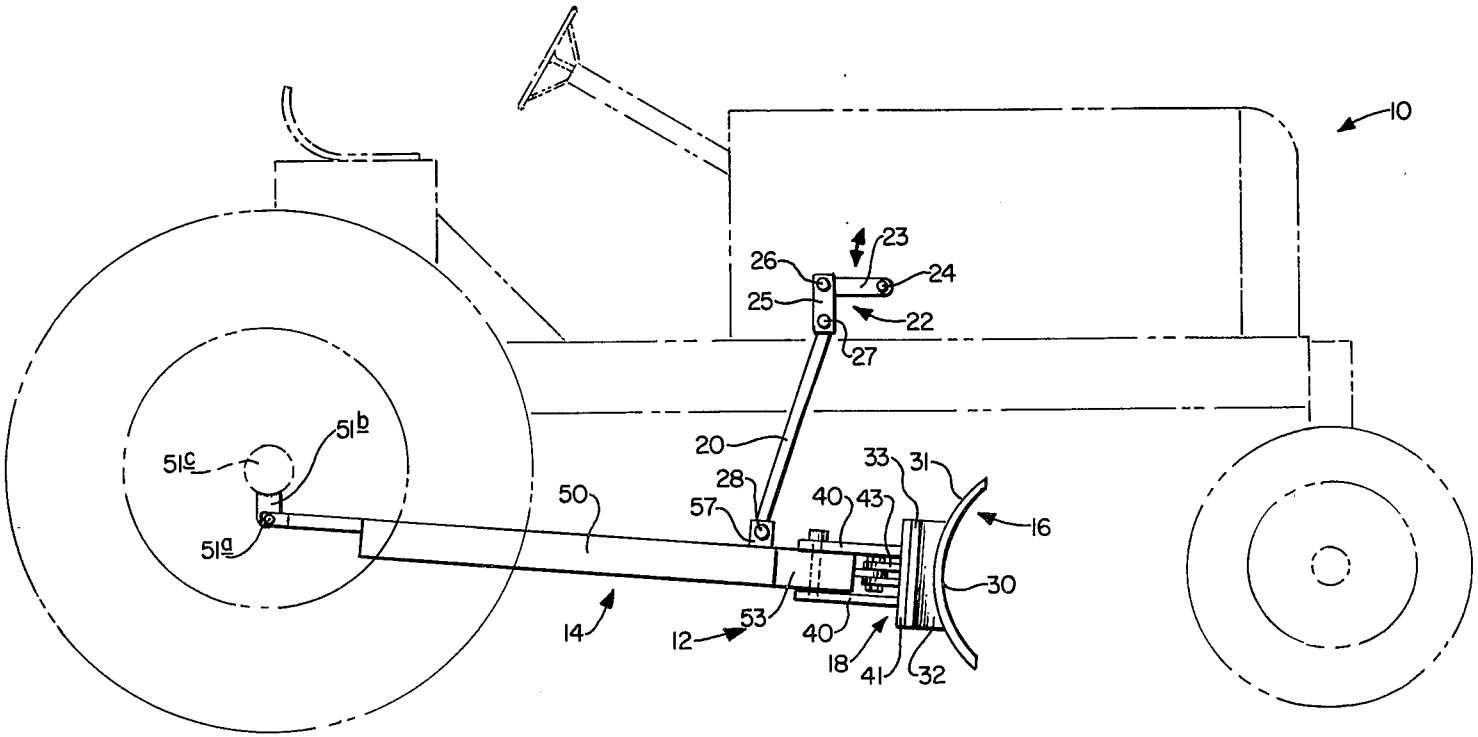
FIG. 1 is a side plan view of a tractor having the grading device of the invention attached thereto.

Referring now to the drawings, in FIG. 1 is shown a tractor 10 having the grader blade attachment, generally indicated by the numeral 12, attached thereto. As can be seen in greater detail in FIG. 2 and the remaining drawings, the grader blade attachment of the invention includes a carrying frame generally indicated by the numeral 14, a blade generally indicated by the numeral 16 and a blade adjusting mechanism generally indicated by the numeral 18.

Blade 16 has a front face 30 which is concave as indicated in the drawings. The back face 31 of blade 16 is convex as indicated in the drawings.

Rigidly affixed to the back face 31 of blade 16 are two support legs 32—32. The support legs may be rigidly affixed to the back face 31 of blade 16 by welding or any other means known in the art.

Figure 4:
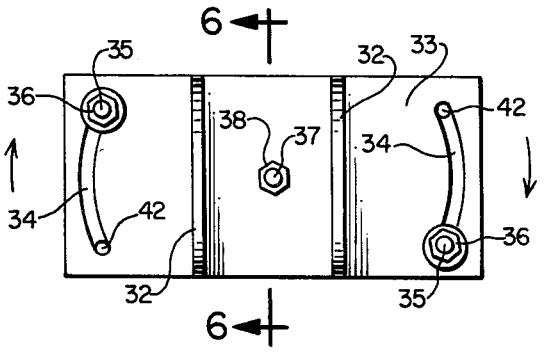
FIG. 4 is an end view of FIG. 2.

Rigidly attached to support legs 32—32 is vertical plate 33 which is shown in detail in FIG. 4. Vertical adjustment plate 33 has two arcuate slots 34—34 therein through which are fitted bolts 35 having conventional nuts 36 thereon. A bolt 37 with nut 38 thereon extends through a hole 39 in vertical adjustment plate 33.

Figure 5:
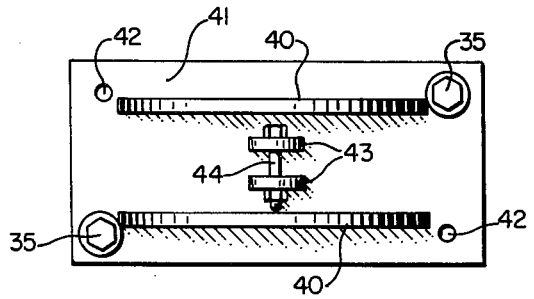
FIG. 5 is the opposite end view of FIG. 2.

Shown bolted to vertical adjustment plates 33 is horizontal adjustment plates 40—40 having base plate 41 to which horizontal adjustment plates 40—40 are rigidly connected such as by welding or the like. Base plate 41 has a series of four bolt holes 42 therein through which are fited bolts for attaching plate 41 to plate 43. Although in FIG. 5 holes 42 are not shown beneath the bolts indicated by the numerals 35, it is to be understood that there are four holes in plate 41 for receipt of bolts.

Also extending outwardly from base plate 41 are two bolt supports 43—43 for receipt of bolt 44. To facilitate the placement of bolt 44 in bolt supports 43—43, a rectangular hole 45 is located in plates 40.

Located in a curved line in plates 40—40 are a series of holes 46. Holes 46 are adapted for receipt of pin 47 shown in FIG. 2.

Figure 2:
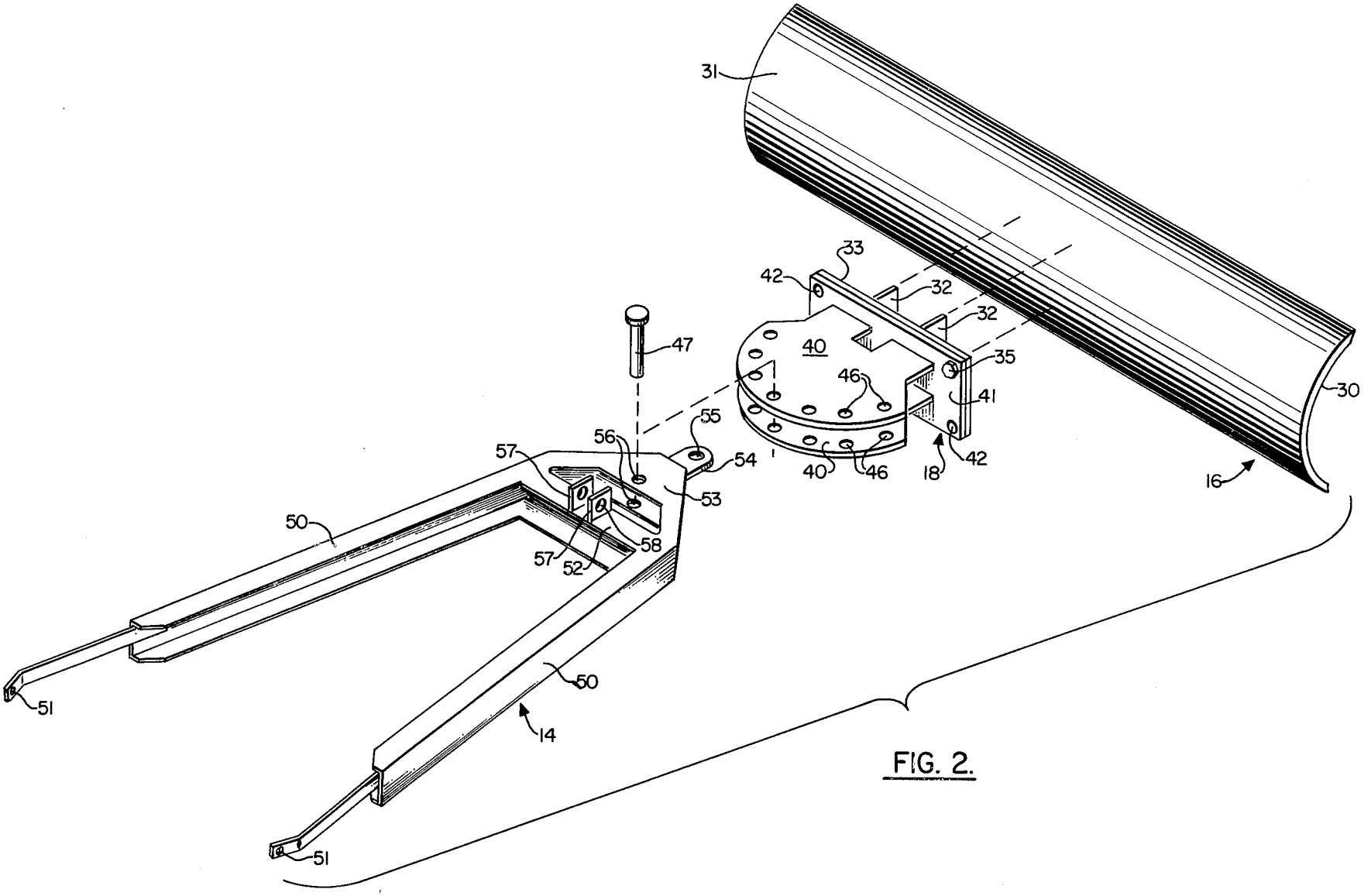
FIG. 2 is an exploded schematic view of the grading device of the invention.
Figure 3:
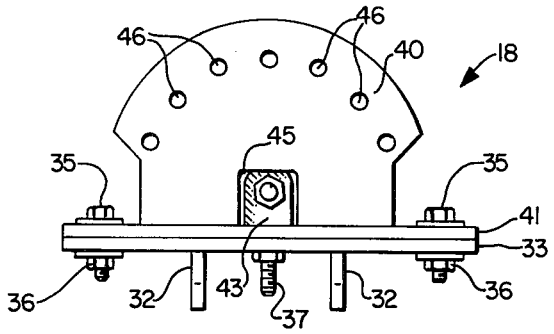
FIG. 3 is a top plan view of the adjusting mechanism of the invention.
Figure 6:
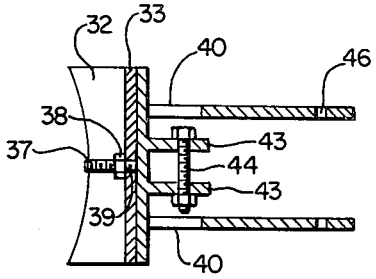
FIG. 6 is a cross-sectional view taken along lines 5—5 of FIG. 3.

Shown in detail in FIG. 2 is carrying frame generally indicated by the numeral 14. Carrying frame 14 includes two symmetrically disposed legs 50 having holes 51—51 in the end thereof for attachment to pins 51*a* located in bracket 51*b* attached to the rear axle 51*c* of the tractor. Frame 14 pivots about pins 51*a* which are inserted in holes 51—51.

Legs 50 are connected at the forward end by a cross bar 52 and come to a point at 53 to form an "A" frame structural member. A tongue 55 extends outwardly from the front end of carrying frame 14 which has hole 55 therein for receipt of bolt 44 shown in FIG. 5 to be held between bolt supports 43=43. Pin 47 is received in hole 56 in the forward portion of carrying frame 14 to connect horizontal adjustment plates 40—40 to carrying frame 14. Extending upwardly from carrying frame 14 is support bar 20 which is connected to a conventional lifting mechanism indicated generally by the numeral 22, which is found on most conventional tractors. The conventional lifting mechanism 22 may be hydraulically operated or mechanically operated.

Lifting mechanism 22 has bar 23 which rotates about pivot pin 24 to lift link 25 which is connected to bar 23 by pivot pin 26. Link 25 in turn is connected to bar 20 by pin 27. Bar 20 in turn is connected to carrying frame 14 by bolt or pin 28. Attached to the upper portion of cross member 52 are bolt supports 57 having holes 58 therein for receipt of bolt 28 shown in FIG. 1.

Thus to adjust blade 16 in a vertical plane, nuts 36 are loosened and plate 33 is turned in the direction indicated by the arrows. Nuts 36 are then tightened and the angle of blade 16 has thus changed. If it is desired to rotate the blade in a direction opposite to that of the arrows nuts 36 are removed from bolts 35 and bolts 35 are placed in the holes immediately above or below the location shown in FIGS. 4 and 5. Thus in FIG. 4, the bolts 35 would be removed and placed in the holes 42 indicated in FIG. 4. Then the blade could be adjusted for rotation in the opposite direction to that indicated by the arrows.

To rotate the blade in the horizontal plane, pin 47 and bolt 44 are removed from hole 56 and bolt supports 43. Thus the pin 47 may be repositioned in any desired hole of set of holes 46 and plate 40 to adjust the angle of the grader blade in the horizontal plane to the desired position. Bolt 44 is then placed through hole 55 in tongue 54 and in the holes in bolt support 43 to prevent the blade and plate 40 from turning about pin 47.

While I have shown and described a preferred embodiment of my invention, I wish that it be understood that I do not confine myself to precise details of the construction herein set forth, by way of illustration, as it is apparent that many changes and variations may be made therein by those skilled in the art without departing from the spirit of the invention or exceeding the scope of the appended claims.

What is claimed is:

1. A grading and dozing attachment for a tractor comprising:

a. a blade adapted to fit between front wheels and back wheels of a tractor, the support for said blade including i. support legs rigidly connected to said blade ii. first vertical adjustment means for adjusting said blade in a vertical plane, said vertical adjustment means including (a) vertical plate means rigidly connected by said support legs to said blade so that said plate is in a generally vertical direction when the blade is in its working position, said plate having two arcuate slots therein, (b) base plate means connectable to said vertical plate means by bolt means, said base plate means having a first set of plural holes therein for receipt of bolts extendable through said holes and said arcuate slots in said vertical plate means, said base plate means having first bolt support means for connecting said base plate means to carrying frame means, said base plate means having a bolt means rigidly connected thereto, said vertical plate means having a first individual hole in the approximate center thereof for receipt of said rigidly connected bolt means, b. carrying frame means adapted to fit between the front wheels and rear wheels of said tractor including i. two symmetrically disposed legs, said legs having a second set of plural holes therein for receipt of first pin means for rotatably connecting said legs to the rear axle of said tractor, cross-member means connecting said legs, said cross-member means having second bolt support means with a third set of plural holes therein for receipt of a bolt to connect said carrying frame means to second vertical adjustment means for pivoting said carrying frame upwardly and downwardly, ii. second vertical adjustment means connectable to a tractor and said carrying frame means for pivoting said carrying frame means upwardly and downwardly about said rear axle, said carrying frame means having a fourth set of plural holes therein for receipt of a second pin means for connecting said carrying frame means to horizontal attachment means and tongue means rigidly connected to said carrying frame means having a second individual hole therein for connecting said tongue means by a bolt to said first bolt support means on said base plate means, c. horizontal adjustment means for adjusting said blade in a horizontal plane connectable to said vertical plate means and said carrying frame means, said horizontal adjustment means including two horizontal plates rigidly connected to said base plate means so that said horizontal plates are generally horizontal when said blade is in its working position, said horizontal plates having a fifth and sixth set of plural holes therein, said holes of said fifth set being aligned with said holes from said sixth set for receipt of said second pin means for connecting said carrying frame means to said horizontal attachment means.

* * * * *